US008408479B2

(12) United States Patent
Di Loreto

(10) Patent No.: US 8,408,479 B2
(45) Date of Patent: Apr. 2, 2013

(54) METHOD AND DEVICE FOR SPRAYING A PULVERULENT MATERIAL INTO A CARRIER GAS

(75) Inventor: Osvaldo Di Loreto, Boussu (BE)

(73) Assignee: FIB-Services Intellectual S.A., Luxembourg (LU)

( * ) Notice: Subject to any disclaimer, the term of this patent is extended or adjusted under 35 U.S.C. 154(b) by 477 days.

(21) Appl. No.: 12/667,820

(22) PCT Filed: Jul. 3, 2008

(86) PCT No.: PCT/EP2008/058565

§ 371 (c)(1),
(2), (4) Date: Feb. 19, 2010

(87) PCT Pub. No.: WO2009/004053

PCT Pub. Date: Jan. 8, 2009

(65) Prior Publication Data

US 2010/0193600 A1 Aug. 5, 2010

(30) Foreign Application Priority Data

Jul. 5, 2007 (BE) ..... 2007/0334

(51) Int. Cl.

| | |
|---|---|
| ***B05C 5/04*** | (2006.01) |
| ***B05B 7/14*** | (2006.01) |
| ***B05B 7/30*** | (2006.01) |
| ***B05B 7/28*** | (2006.01) |
| ***B05B 7/12*** | (2006.01) |
| ***B05B 7/04*** | (2006.01) |

(52) U.S. Cl. ..... 239/85; 239/379; 239/407; 239/434

(58) Field of Classification Search ..... 239/8, 11, 239/79, 80, 85, 379, 398, 407, 433, 434, 239/589, 592, 594, 597, 601; 427/180, 446; 118/308

See application file for complete search history.

(56) References Cited

U.S. PATENT DOCUMENTS

| | | | | |
|---|---|---|---|---|
| 4,343,605 | A | 8/1982 | Browning | |
| 5,302,414 | A * | 4/1994 | Alkhimov et al. | 427/192 |
| 5,330,798 | A | 7/1994 | Browning | |
| 6,402,050 | B1 | 6/2002 | Kashirin et al. | |
| 6,502,767 | B2 * | 1/2003 | Kay et al. | 239/433 |
| 2003/0190414 | A1 * | 10/2003 | Van Steenkiste | 427/201 |
| 2005/0161532 | A1 | 7/2005 | Steenkiste et al. | |
| 2006/0113359 | A1 * | 6/2006 | Teets et al. | 228/261 |
| 2006/0201418 | A1 * | 9/2006 | Ko et al. | 118/308 |
| 2008/0048048 | A1 * | 2/2008 | Noestheden | 239/101 |

OTHER PUBLICATIONS

International Search Report in PCT/EP2008/058565 dated Sep. 22, 2008 (3 pages).

* cited by examiner

*Primary Examiner* — Darren W Gorman
(74) *Attorney, Agent, or Firm* — McCracken & Frank LLC

(57) ABSTRACT

Method of spraying a pulverulent material into a carrier gas, comprising the acceleration of the carrier gas under pressure up to a sonic velocity before an expansion enabling the pulverulent material to be entrained, with formation of a constant stream of carrier gas entraining an adjustable predetermined amount of pulverulent materials, and safety device for spraying pulverulent material into a carrier gas.

17 Claims, 4 Drawing Sheets

METHOD AND DEVICE FOR SPRAYING A PULVERULENT MATERIAL INTO A CARRIER GAS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCOPRORATION-BY-REFERENCE OF MATERIAL SUBMITTED ON A COMPACT DISC

Not applicable.

SEQUENCE LISTING

Not applicable.

BACKGROUND OF THE INVENTION (1) Field of the Invention

The present invention relates to a method for spraying a pulverulent material into a carrier gas having a total flow rate, said method comprising

- a flow of said pressurized carrier gas,
- an acceleration of said pressurized carrier gas to a sonic velocity,
- an expansion of said pressurized carrier gas with formation of a negative pressure zone having a value lower than said carrier gas flow pressure and an entrainment of an amount of said pulverulent material by said expanded carrier gas, and
- a spray of said pulverulent material entrained by said carrier gas.

(2) Description of Related Art including information disclosed under 37 CFR 1.97 and 1.98.

Such a method is known for example from document U.S. Pat. No. 6,402,050, which describes apparatus for the dynamic spraying of pulverulent materials by gases in the field of the production of coatings, for example corrosion-resistant or reflecting coatings for machined surfaces.

This document describes the use of a sonic throat with a particular ratio of the cross sections between the sonic throat and the pulverulent material feed, in order to maintain a pressure lower than atmospheric pressure for transporting the powder by an air stream at atmospheric pressure. This document does not disclose that the sonic nozzle serves to obtain a constant flow rate of pulverulent material.

However, in the field of the repair of the refractory furnace walls by flame spraying, gunning, ceramic welding or reactive spraying, the reproducibility of a method for spraying pulverulent material and all the adjustments pertaining thereto, like those of the amount of pulverulent material, the spray velocity, the impact force, etc., are directly and harmfully affected by a non-reproducible variable carrier gas flow rate.

Obviously, devices are known for comprising a flowmeter which, via a controller, controls a valve to obtain a constant gas flow rate, but such systems are complicated to apply and demand elements of which the purchase price and operation are directly related to the accuracy. Accordingly, these systems are relatively inapplicable, not to mention the fact that the final accuracy (probably due to the sequence of elements) is often insufficient.

Furthermore, certain known methods in the field of repair by spraying pulverulent material comprise an adjustment of the amount of pulverulent entrained by means of an endless screw or a discharge revolving table, but the use of such entrainment devices requires the use of electric motors, which is incompatible with the use of a carrier and reactive gas (for example oxygen) with at least one element of said pulverulent material.

To ensure the safe use of these electric motors, an inert gas would have to be used, for example nitrogen, but this is incompatible with the inventive method, because the carrier gas must be reactive with an element of the pulverulent material and in every case requires an additional nitrogen feed, making the method less flexible.

It is therefore an object of the invention to overcome these drawbacks by providing a method in which the flow rate of pulverulent material is adjustable and reproducible without affecting the carrier gas flow rate.

For this purpose, the inventive method is characterized in that it further comprises an adjustment of said lower pressure, which exists in the negative pressure zone by the bypassing or not, before the expansion, of an adjustable amount of said carrier gas having been accelerated to reintroduce said adjustable amount into the aforesaid negative pressure zone without changing said flow rate, in particular in its totality.

The amount of instantaneous pulverulent material entrained should advantageously be optimized with regard to the excellence of the coating, but also from the standpoint of the cost of consumption thereof. Upstream of the spray pipe or nozzle, it is therefore important to be able to mix the pulverulent material intimately with an adjustable amount of carrier and reactive gas. Accordingly, the value of the latter parameter is also dictated by necessity.

The inventive method as described above has the desired flexibility with regard to a conventional method using a venturi effect. This is because the spray method according to the invention, by comprising a step of adjustment of said negative pressure by the bypassing or not, before the expansion, of an adjustable quantity of carrier gas having been accelerated, makes it possible, while making no change to the carrier gas outlet flow rate, to change the value of the lower pressure in the negative pressure zone, thereby serving to adjust the amount of pulverulent material entrained.

If the amount of carrier and reactive gas withdrawn and reintroduced is high, the value of the pressure in the negative pressure zone is closer to the compression pressure and the amount of entrained pulverulent material is lower. On the contrary, if the amount of carrier and reactive gas withdrawn and reintroduced is low, the value of the pressure in the negative pressure zone is sharply decreased in comparison with the aforesaid compression pressure value and a large amount of pulverulent material close to its maximum value will also be entrained. If the amount of bypassed carrier gas is zero, the value of the negative pressure is a maximum and has the furthest value from the compression pressure that the method can reach, and the maximum amount of pulverulent material is entrained. Accordingly, the amount of carrier and reactive gas bypassed (that is withdrawn and reintroduced) serves to very advantageously adjust the amount of pulverulent material entrained.

The invention has therefore served to overcome at least part of the drawbacks of the prior art by allowing the adjustment of the amount of entrained pulverulent material to a reproducible value, while ensuring a constant carrier gas flow rate, thereby guaranteeing a constant ejection speed. In fact, the final result, the reproducibility and the quality of the spraying, depend directly on this flow rate of pulverulent material entrained by said carrier gas.

An optimal carrier gas flow rate ensures optimal transport of the material to be sprayed, and since the spraying is carried out via a spray pipe or nozzle, having a clearly defined spray cross section, the spray velocity for a given carrier gas temperature is therefore conditioned by the flow rate of this carrier gas.

Thanks to the acceleration to sonic velocity, for example obtained by creating a shock wave in a venturi, the sonic barrier establishes a fixed flow rate which is not influenced by the pressure drop variations in the downstream circuit. Accordingly, the carrier gas flow rate has become constant and the spray velocity condition by this constant flow rate is optimal. The optimal ejection speed thus obtained in the carrier gas considerably increases the reliability and reproducibility of the inventive method for spraying pulverulent material.

In the field of the repair of refractory walls of furnaces, glass treatment installation, coke ovens, etc., the inventive method can be applied advantageously in a reactive spraying repair method which consists in spraying a pulverulent material (comprising for example a refractory filler and metal powder), finely atomized, by means of a carrier gas stream on a target zone.

In fact, when a refractory wall has superficial or deep damage, the user must repair it as quickly as possible to avoid aggravating the damage, considering the intense operating conditions.

During the reactive spraying repair operation, the quality of the coating obtained on the generally refractory wall depends on several parameters, including in particular the temperature of the support and the spray velocity.

In this type of method, the carrier gas may also advantageously be a gas that is reactive with at least one of the elements of the pulverulent material and, in contact with the hot wall, the mixture reacts spontaneously and a series of chemical reactions leads to the formation of a homogenous, adhesive refractory material whose properties are compatible with those of the support treated.

The spray velocity is a predominant factor. This is because if it is too low, there is a risk of flashback. If it is too high, the amount of material may not react (because it does not participate in the exothermic reaction) and may rebound excessively on the wall, to the detriment of the quality of the magma under formation caused by the reactive spraying.

It is therefore an object of the inventive method to obtain an optimal weld quality by procuring a quality of spraying and impact of said pulverulent material on the surface to be repaired that is constant over time. The inventive method is suitable for obtaining a carrier and reactive gas flow rate that depends directly on the inlet pressure that is independent of any change in pressure resulting from the downstream circuit.

The grains making up the sprayed pulverulent material are activated within optimized velocity thanks to the carrier gas which transports the pulverulent material pneumatically and the amount is adjustable.

In this type of reactive spraying repair application, the carrier gas is also a reactive gas which serves not only as a transport fluid but also participates actively in the exothermic physicochemical reaction. The final quality of the sprayed project essentially depends on the following factors:

- the total enthalpy produced during the exothermic reaction depends on the amount of carrier and reactive gas used, and also the temperature, chemical composition or formulation of the pulverulent material,
- the amount of powder sprayed, that is the mass flow rate of pulverulent material,
- the optimal flow rate of carrier and reactive gas used to obtain the optimal ejection speed of the reactants for a given application.

Since the carrier gas flow rate, according to the invention, advantageously has a constant value at the outlet, free of any variation due to imperfections, the inventive method provides an optimal spraying velocity for a given application.

Advantageously, the inventive method further comprises a compression of said reactive carrier gas having been accelerated previously to the expansion, thereby serving to improve the entrainment of the aforesaid pulverulent material.

Other embodiments of the inventive method are mentioned in the appended claims.

BRIEF SUMMARY OF THE INVENTION

The invention further relates to a device for spraying a pulverulent material into a carrier gas comprising:

- a pressurized carrier gas inlet,
- a sonic throat convergent-divergent nozzle communicating with said pressurized carrier gas inlet,
- a pulverulent material feed communicating with a negative pressure zone,
- means for expanding the carrier gas connected to said sonic throat convergent-divergent nozzle receiving the pressurized carrier gas and terminating in said negative pressure zone and
- an outlet of said pulverulent material entrained by said expanded carrier gas outside the negative pressure zone.

Unfortunately, as mentioned above, such a device does not make it possible to obtain an optimal spraying of pulverulent material, thus jeopardizing, on the one hand, the reproducibility of the work done by this device and, on the other hand, the quality of the finished work, nor to adjust the amount of pulverulent material entrained.

It is the object of the invention to overcome the drawbacks of the prior art by providing a device suitable for obtaining an optimal spraying velocity for a selected powder mass flow rate, that increases the reproducibility of the work done by the user of the device according to the invention and the accuracy, as well as the cost of pulverulent material.

To solve this problem, the invention provides a device as described above, characterized in that it further comprises a device for adjusting the flow rate of said pulverulent material in said carrier gas comprising a bypass circuit of said carrier gas equipped with a member for adjusting the amount of bypassed carrier gas, said bypass circuit comprising a carrier gas sampling process placed upstream of said negative pressure zone.

Said sonic throat convergent-divergent nozzle serves to maintain, downstream, a constant flow rate of carrier gas entraining a predefined amount of pulverulent material which is therefore adjustable thanks to the bypass means.

In this way, the carrier gas passing through the sonic throat convergent-divergent nozzle—also called a Laval nozzle—undergoes an acceleration to a sonic velocity thanks to a shockwave which has been created in the venturi. The sonic barrier thus obtained establishes a fixed flow rate which is not influenced by the pressure difference between the upstream and downstream parts of the nozzle. Furthermore, the amount of adjustable pulverulent material is also optimized. Thus the flow rate of the mixture of pulverulent material in the carrier gas is optimal and also the exothermic reaction. The total spraying is optimized and the efficiency is increased.

The carrier gas reintroduced into the negative pressure zone causes a back-pressure which acts on the negative pressure so the larger the amount of carrier gas reintroduced into the negative pressure zone, the lower the amount of entrained pulverulent material. The opposite also applies. If the user wants to entrain the maximum amount of pulverulent material, it suffices to avoid withdrawing any carrier gas. The amount of carrier gas withdrawn and reintroduced is adjusted using the control member.

Advantageously, the inventive device comprises an injector communicating on the one hand with said sonic throat convergent-divergent nozzle and on the other hand, with said expansion means and said negative pressure zone said injector comprising at least one contraction zone. The presence of the injector improves the entrainment of the pulverulent material in the negative pressure zone and the contraction zone serves to increase the pressure just before the expansion. Accordingly, the pressure difference is greater and also the entrainment efficiency.

Preferably, said control member of the bypass circuit is a needle valve. This serves to obtain all possible values between the maximum value of gas withdrawn and the minimum value, the needle valve operating by tightening and not by increments.

Advantageously, said sampling orifice is placed upstream of said contraction zone of said injector. In this way, the carrier gas which must be bypassed to adjust the amount of pulverulent material is withdrawn before the compression and represents a back pressure with regard to the pressure (lower pressure) prevailing in the negative pressure zone, thereby allowing a more sensitive adjustment of the amount of pulverulent material withdrawn.

In an advantageous embodiment, the negative pressure zone is connected to a divergent passage, preferably made from tungsten carbide, itself connected to said outlet orifice of said pulverulent material entrained by the carrier gas. The diversion passage is preferably made from an abrasion-resistant material such as, for example, tungsten carbide, and serves to obtain an operation similar to that of a nozzle.

In a particularly advantageous embodiment, said sonic throat convergent-divergent nozzle has a diameter lower than the diameter of each element downstream of said sonic throat convergent-divergent nozzle.

Accordingly, it is said sonic throat convergent-divergent nozzle which dictates the constant flow rate up to the outlet of the inventive device.

In a preferred embodiment of the invention, the outlet of pulverulent material entrained by said carrier gas is a tubular orifice comprising the diversion passage, in which a first casing surrounds at least said tubular outlet orifice and in which a second casing surrounds a flexible hose leading to a spray nozzle connected to said outlet, the two casings being joined together by conventional connecting means. This serves to obtain a device for spraying pulverulent material into a carrier gas that is compact and portable, and which is sufficiently safe. This is because the fragile elements confined within it are protected from the environment. Any accidental exothermic reactions liable to occur during the spraying are also confined in the inventive device and in the second casing, thereby serving to avoid injuring the user. The second casing is particularly appropriate in case of flashback to prevent a user from being burned, because the carrier and reactive gas is generally oxygen.

Preferably, a thermofusible wire is connected on the one hand to a trigger which comprises an open carrier gas flow position and a closed carrier gas blocking position and on the other hand, in said second casing, said thermofusible wire is arranged to maintain said trigger in the open position. In this way, in case of flashback, the thermofusible wire breaks instantaneously and the trigger switches almost instantaneously into the closed carrier gas (oxygen) blocking position. This helps to avoid the backward propagation of the flame front and hence explosion or fire.

In a particularly safe embodiment, said first and said second casings are joined to one another by return means having a predefined return force, for example springs that keep all the conventional connecting means together.

The loading of the springs is such that, during an overpressure due to a flashback in the tubular outlet orifice, the latter separates from the divergent nozzle, thereby directly allowing a return to atmospheric pressure. Accordingly, these two elements separate from one another for a few very short moments, thereby also serving to prevent explosion or fire. Advantageously, the second safety casing comprises two filtration devices which allow the removal of the gases and the dust, while blocking a propagation of the flames during such an incident.

Other embodiments of the device according to the invention are indicated in the appended claims.

Other features, details and advantages of the invention will appear from the description given below, which is nonlimiting and in conjunction with the appended drawings.

BRIEF DESCRIPTION OF THE SEERAL VIEWS OF THE DRAWINGS

DETAILED DESCRIPITION OF THE INVENTION

Figure 1:
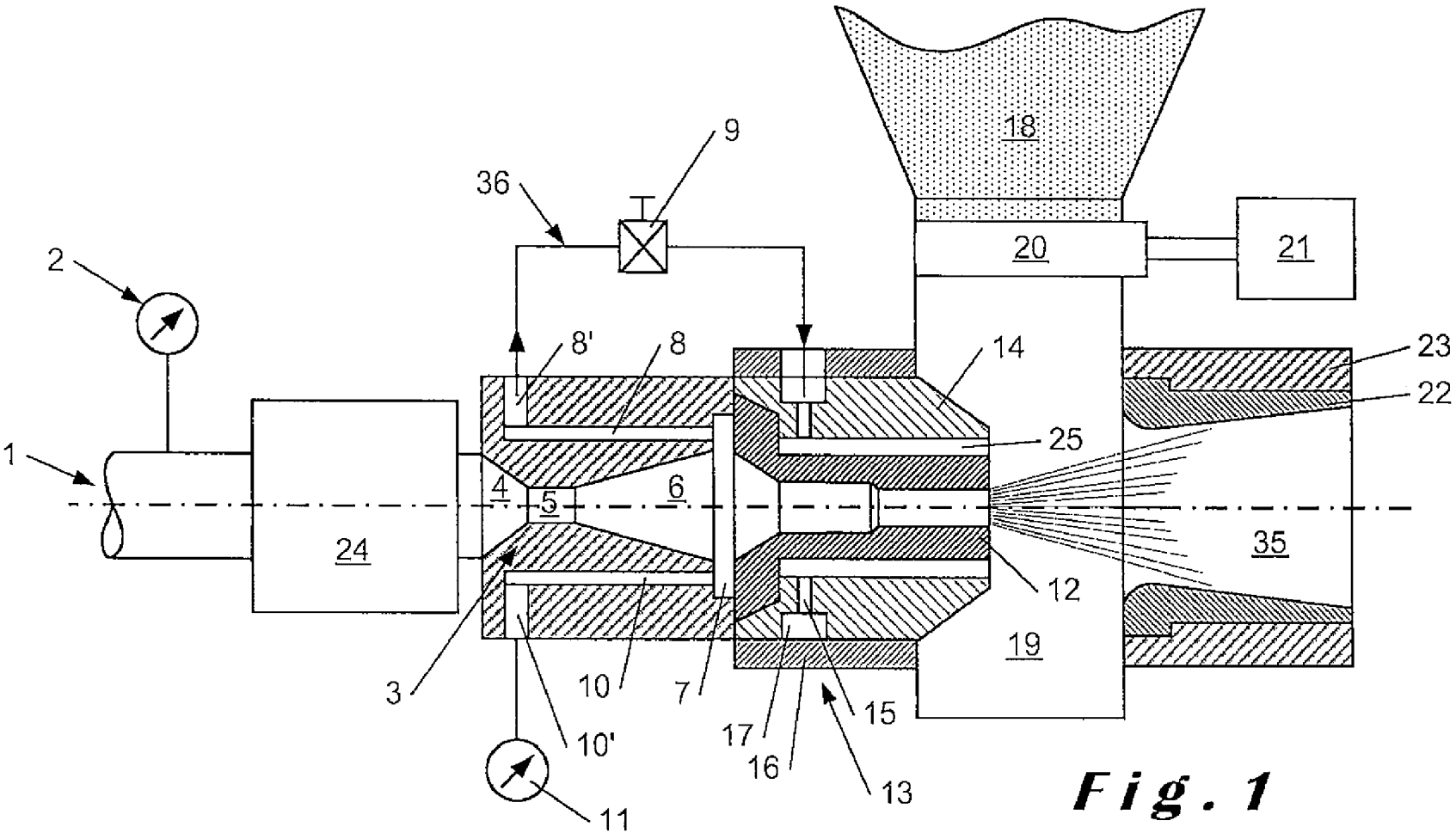
FIG. 1 shows a cross section of a device for spraying pulverulent material into a carrier gas according to the invention.

In the figures, the identical or similar elements have the same reference numerals.

FIG. 1 shows a device for spraying pulverulent material into a carrier gas for implementing the spraying method according to the invention. As mentioned above, the principle consists in spraying a finely atomized pulverulent material on a target zone using a carrier gas. The carrier gas is, for example, also reactive with an element of the pulverulent matrix. The reactive carrier gas is for example oxygen, which participates in the exothermic reaction of the metal powder contained in the pulverulent material.

The inventive device shown in FIG. 1 comprises an inlet 1 for pressurized oxygen gas issuing either from a carboy, or from a tank compressed for example to 200 bar. The pressure of the pressurized oxygen entering the device according to the invention have previously been regulated by means of a pressure reducer 2 or a plurality of pressure reducers 2 in series connected to the carboy or to the tank (not shown). A value of this pressure of pressurized oxygen given as an example is 5.2 bar. The pulverulent material enters the inventive device via a pulverulent material feed hopper 18. The pressurized oxygen gas enters the inventive device via the aforesaid inlet 1 and reaches the nozzle 3 of the Laval type, that is convergent-divergent, of which the dimensional factors are such that the nozzle 3 is considered as sonic. The Laval nozzle comprises a conversion section 4, a sonic throat 5 and a divergent section 6.

The nozzle 3 is followed in the embodiment shown by a recess 7. The recess 7 advantageously comprises at least one oxygen bleed for bypassing an amount of oxygen accelerated by said nozzle 3. Part of the carrier and reactive oxygen is therefore bypassed via two perpendicular bores 8, 8' connected to a needle valve 9 which serves to adjust the value of the amount of bypassed oxygen. It is also provided in the embodiment shown to measure the value of the static pressure of the oxygen accelerated by the nozzle 3 by means of two perpendicular bores 10, 10' made in said recess 7. This static pressure is for example measured using a pressure gauge 11.

The sonic throat Laval or convergent-divergent nozzle 3 is joined to an injector 12 which is fed with carrier gas having been accelerated (oxygen) with a flow rate, pressure and velocity dictated by the aforesaid conversion-divergent nozzle 3.

The injector 12 is preferably made from a material compatible with the passage of oxygen. The carrier and reactive oxygen with at least one element of the pulverulent material, which has passed through the injector, under high pressure, then terminates in a negative pressure zone 19, which in this embodiment is a chamber having a volume much larger than that of the nozzle of the injector 12 and thereby serving as expansion means. The expansion of the carrier gas creates a negative pressure in the aforesaid chamber which has the effect of entraining the pulverulent material present in the feed hopper 18. Advantageously, the chamber is fed with pulverulent material by retracting a shutter 20 controlled by control means, for example, pneumatically using a cylinder 21.

The expansion means may consist of any known expansion means, like the chamber having a higher volume than that of the aforesaid injector, or the divergent part of a venturi.

The position of the injector 12 is advantageously collinear with the outlet 22 of the pulverulent material entrained by the carrier and reactive oxygen. The outlet is equipped with a divergent unit 22 consisting of an abrasion-resistant material such as, for example, tungsten carbide.

Injector 12 comprises a contraction zone for compressing the accelerated carrier gas before it reaches the negative pressure zone 19.

In this illustrated embodiment, the Laval nozzle 3 is joined to a preferably metal unit 13 which consists of three coaxial subunits 12, 14, 16. The preferably metal subunit 14 comprises a groove 17 on its outside diameter, into which radially produced bores 15 allow the passage of part of the oxygen flow from the conduit connected to the needle valve 9. The subunit 16 is a ring for closing the groove 17 of the subunit 14. The ring 16 allows the connection of the needle valve 9 via a bore made in the ring 16, opposite the aforesaid groove 17.

The needle valve 9 is then connected to the bore 8 and/or to the bore 8' by a conduit 36 of a material compatible with the passage of oxygen. The closing and opening of the needle valve 9 allows or prevents the bypass (withdrawal) into the bypassed circuit 36 of an amount of oxygen necessary for the operating conditions. The oxygen withdrawn into the recess 7 (withdrawal orifice) via an opening of the needle valve 9 is then reintroduced via the circuit 36 into the ring 17 (carrier gas reintroduction orifice), passes into the bore 15 and then terminates in an annular space 25 existing between the metal subunit 14 and the injector 12. In this way, at the outlet of the injector 12, the accelerated oxygen flow rate at the outlet of the sonic throat convergent-divergent nozzle 3 is recovered. The expression bypassed circuit 36 is applied to the assembly consisting of the recess 7, the bores 8, 8', the needle valve 9, the reintroduction orifice 17, the bore 15 and the annular space 25.

In fact, the accelerated oxygen leaving the nozzle 3 has a flow rate $d_L$, a velocity $v_L$ and a pressure $P_L$. When part $d_D$ of the accelerated oxygen flow $d_L$ is bypassed, the oxygen flow rate passing into the injector is $d_i$. The oxygen that passes into the injector is activated with a velocity $v_i$ and has a pressure $P_i$. The oxygen of the part of the bypassed flow $d_D$ is also activated with a velocity $v_D$ and has a pressure $P_D$ in the annular space 25.

At the outlet of the injector 12 and the annular space 25, the oxygen has a resulting pressure $P_R$ and a resulting velocity $v_R$. These resulting pressures and velocities condition the amount of entrained pulverulent material. The opening and closing of the needle valve 9 causes a variation of the flow rates $d_i$ and $d_D$, a variation in the pressures $P_i$ and $P_D$, and changes in velocity $v_i$ and $v_D$. The resulting pressure $P_R$ and the resulting velocity $v_R$ are accordingly variable. The direct consequence is a variation in the amount of entrained pulverulent material, due to the variation of kinetic energy and the momentum. This causes a change in the scale of the venturi effect generated.

However, the values of the accelerated carrier gas flow rate $d_L$ at the outlet of the Laval nozzle 3 and of the oxygen flow rate leaving the inventive device $d_R$ are identical since the carrier gas flow rate remains constant during the passage through the inventive device.

Thus, thanks to the deviation or bypassing of part of the flow rate $d_D$, via the opening of the needle valve 9 into the bypass circuit 36, the flow rate passing into the injector 12 $d_i$ is commensurately decreased. The property such as the pressure $P_i$, mass flow rate $M_i$ and velocity $v_i$ at the outlet of the metal injector are modified.

If the needle valve 9 is completely open and allows the maximum oxygen flow to pass through corresponding to the maximum possible value of $d_D$ (bypassed oxygen flow rate), the amount of entrained pulverulent material will be the minimum amount of pulverulent material which can be entrained by the inventive device (instantaneous amount).

If the needle valve 9 is closed and does not allow any bypass, the amount of entrained pulverulent material is then at its maximum value. Since the bypass is not always necessary, it is advisable to provide for the possibility of closing the adjustment member and in this case the needle valve 9 (instantaneous amount).

In an alternative, the groove 17 may be an integral part of the support body of the assembly 13. Similarly, the person skilled in the art will easily understand that the geometric positions of the radial bores may be quite different according to the dimensional requirements.

The bores 8' and 10' are machined perpendicular to the two bores 8 and 10, which are themselves located orthogonally to the plane formed at the recess 7, but the person skilled in the art will easily understand that these geometric positions are only dictated by steric constraints and the dimensional requirements. It goes without saying that a single bore 8, 10 could suffice to bypass the accelerated oxygen or to measure the value of the static pressure and that there is no position limitation for the alternatives according to the invention.

The dimensional factors of the Laval nozzle are such that the static pressure of the oxygen passing through said nozzle 3 has a value equal to or lower than the product of the pressure at the nozzle inlet (compression pressure) multiplied by a factor of 0.528. In these conditions the nozzle 3 is considered as sonic and the operating conditions of the assembly only depend on the initial pressure of the fluid upstream, that is the pressure dictated by the pressure controller 2, consisting for example of one or more pressure reducers 2.

The tungsten carbide divergent nozzle 22 can be positioned and fixed in a support block 23.

The dimensional factors of the injector 12 and divergent nozzle 22 combination are such that the operating principle can also be treated as that of the venturi nozzle.

In an alternative according to the invention, upstream of the sonic throat convergent-divergent nozzle 3, a nonreturn safety 24 is located, comprising a valve with a normally open trigger and serving to prevent the backflow of gas into the inventive device. This is because in the case of hot oxygen or a flashback it is advantageous to have a nonreturn safety that blocks the passage in case of heating or return of slag.

Figure 2:
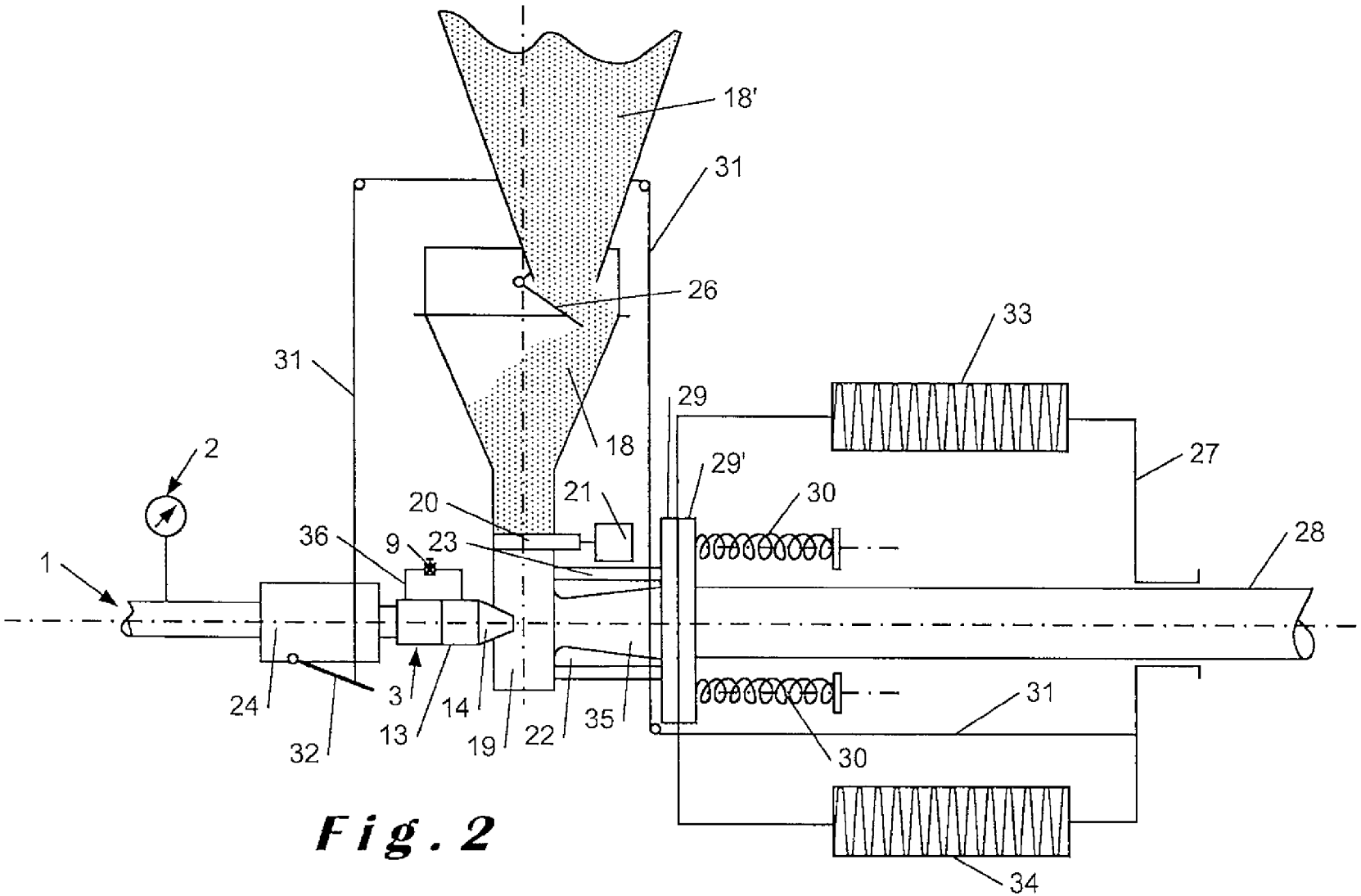
FIG. 2 shows a cross section of a complete set comprising the same device as the one shown in FIG. 1, where details of the thermofusible wire, the second casing and the loaded springs according to the invention can be observed.

FIG. 2 shows a more complete reactive spray repair unit comprising the same device as the one shown in FIG. 1. In this unit, a hopper 18' having a larger capacity than the aforesaid feed hopper 18 is positioned above the latter. The pulverulent material consisting of refractory and metal powder used in the inventive method is therefore transferred from the hopper 18' to the hopper 18 by natural flow and by gravity.

In the feed hopper 18 terminating in the negative pressure zone 19, a mobile damper 26 has been advantageously placed to allow a regular flow into the chamber for mixing carrier gas (oxygen) and powder. In the case of a flashback and in the case of a gas backflow liable to rise in the hopper 18, since the pulverulent material therein is reactive (at least one of its constituent elements) with the carrier gas (oxygen), the amount of pulverulent material capable of causing an explosion is reduced, and in consequence the amount of pulverulent material lost.

The device shown in FIG. 2 also comprises, as mentioned previously, a support block 23 that is also called the first casing 23 in the context of the present invention, surrounding the outlet 35 of pulverulent material entrained by the carrier gas in the form of a divergent flow tubular orifice 22 (for example, made from abrasion-resistant tungsten carbide). The inventive device, in its preferable embodiment shown here, further comprises a second casing 27. The second casing 27 surrounds the reactive spray nozzle 28 of the pulverulent material entrained by said carrier and reactive gas.

The first casing 23 is connected to the second casing 27 by conventional connecting means 29 and 29' such as a threaded protrusion and a screw thread, flanges and similar. The conventional connecting means 29 and 29' are kept in place thanks to the pressure exerted by a series of return means 30 having a predefined return force. These return means 30 are for example loaded springs 30. The predefined return force or the spring loading is such that during an overpressure in the spray nozzle 28 due to a flashback the two conventional connecting means separate. This allows an instantaneous return to atmospheric pressure in the chambers in which a pressure favorable to ignition and explosion previously prevailed.

As may also be observed, the inventive device also comprises an additional safety device. In fact, in addition to the nonreturn safety 24, the mobile damper 26 in the aforesaid feed hopper 18, the first and second casings 23 and 27, the return means 30, the device also has a judiciously positioned thermofusible wire 31. The thermofusible wire 31 is located in the path of the hot gas stream. When the conventional connecting means 29 and 29' separate under the effect of an overpressure due to an incident or during a flashback occurring in said second casing 27, the hot gas stream immediately melts the thermofusible wire 31 which is then nearly instantaneously cut. Its rupture serves to release the tension under safety trigger 32. The sudden release of the trigger 32 interrupts the oxygen flow and the passage of gas is blocked.

Furthermore, the inventive device is equipped in the second casing 27 with filtration devices 33 and 34 for the cooled removal of the gas and dust during such an incident (flashback).

Figure 3:
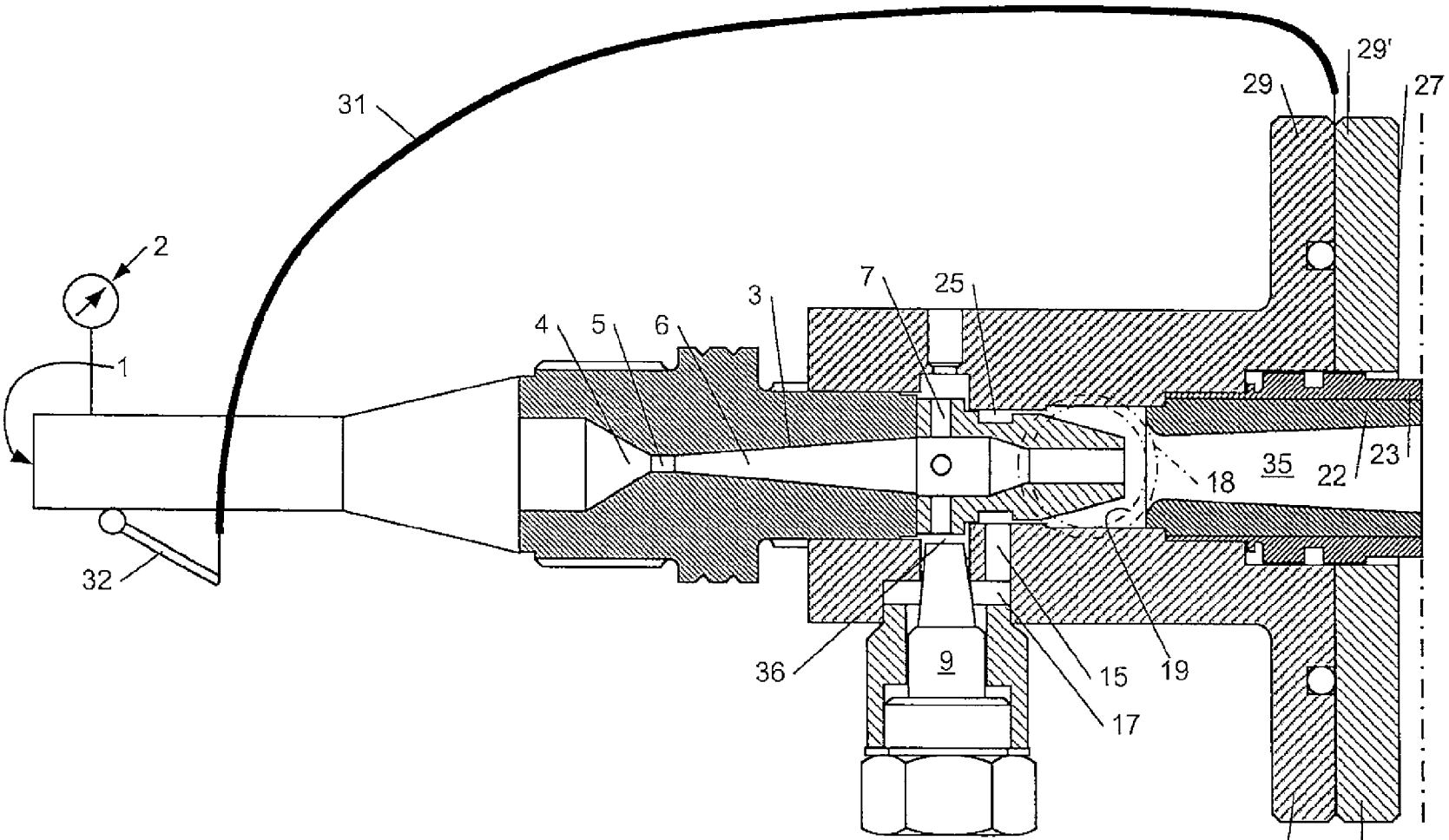
FIG. 3 shows a plan view of an alternative device for spraying a pulverulent material into a carrier gas according to the invention.

In the alternative of the inventive device shown in FIG. 3, the bypass circuit for adjusting the amount of pulverulent material entrained by the carrier reactive gas is positioned differently. The other elements shown operate as in and are described by the detailed description of FIGS. 1 and 2 including all the alternatives explained.

The bypass circuit 36 comprises a member 9 (needle valve) for adjusting the amount of carrier gas bypassed, a carrier gas sampling orifice 7 and a reintroduction orifice 25 for the gas bypassed into the chamber of the negative pressure zone. The sampling or withdrawal orifice 7 is placed at the outlet of the Laval nozzle 3. Obviously, this withdrawal orifice can be placed in many other locations, and in as much as it is placed upstream of said expansion zone 19 of said carrier gas the operation is optimal.

Similarly, as an alternative, a thermofusible wire 31 is connected on the one hand to the trigger 32 and on the other hand to a point located between said first 23 and said second casing 27. The (thermofusible) wire 31 keeps the trigger 32 in the open position as long as there is no flashback. If an incident were to occur, the conventional connecting means 29, 29' separate from one another and the end of the (thermofusible) wire 31 is released, having the effect of releasing the pressure on the trigger and blocking the oxygen feed.

Figure 4:
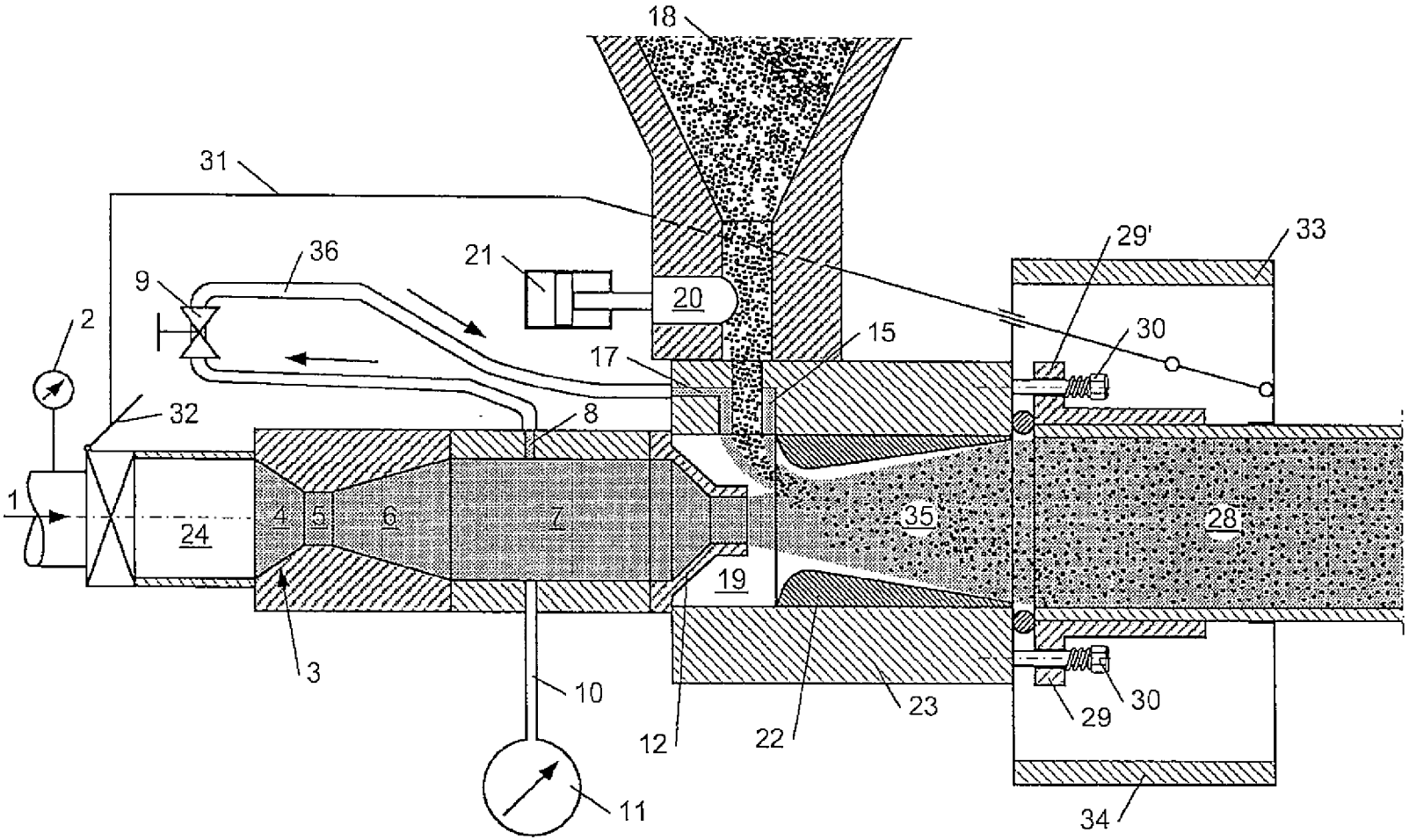
FIG. 4 shows a cross section of a complete set of an alternative of the device shown in FIG. 1.

FIG. 4 shows an alternative of the device shown in FIG. 1, in which the bypass circuit is also positioned differently. The other elements operate as in the embodiment shown in FIG. 1.

The inventive device shown in FIG. 4 comprises a pressurized oxygen gas inlet 1. The pulverulent material enters the inventive device via the pulverulent material feed hopper 18. The pressurized oxygen gas enters the inventive device by the aforesaid inlet 1 and reaches a Laval (sonic) nozzle 3. The Laval nozzle comprises a convergent section 4, a sonic throat 5 and a divergent section 6.

The nozzle 3 is followed in the embodiment shown by a recess 7. The recess 7 advantageously comprises at least one oxygen withdrawal for bypassing an amount of oxygen accelerated by said nozzle 3 by means of an orthogonal bore 8 connected to a needle valve 9 which serves to adjust the value of the amount of bypass oxygen. It is also provided in the embodiment shown to measure the value of the static pressure of the oxygen accelerated by the nozzle 3 by means of an orthogonal bore 10 made in said recess 7, for example using a pressure gauge 11.

The recess connected to the Laval nozzle is joined to an injector 12 which is fed with accelerated carrier gas (oxygen) with a flow rate, pressure and velocity dictated by the aforesaid nozzle 3. The nozzle 3 has a diameter of 3.4 mm for example.

The injector 12 which has for example a diameter of 3.7 mm thus terminates in a negative pressure zone 19, which is, also in this embodiment, a chamber having a volume much higher than that of the nozzle of the injector 12 and also serving as expansion means. The expansion of the carrier gas creates a negative pressure in the aforesaid chamber which has the effect of entraining the pulverulent material present in the feed hopper 18. Advantageously, the chamber is fed with pulverulent material by the retraction of a shutter 20 controlled by control means, for example, pneumatically using a cylinder 21.

The position of the injector 12 is advantageously collinear with the outlet 22 of the pulverulent material entrained by the carrier and reactive oxygen. The outlet is equipped with a divergent nozzle 22 consisting of an abrasion-resistant material such as tungsten carbide for example.

The injector 12 comprises a contraction zone allowing compression of the accelerated carrier gas before it terminates in the negative pressure zone 19.

In this embodiment shown, the injector 12 is joined to the support block 23 which confines said negative pressure zone 19 and the divergent passage 22 defining the outlet 35.

The support block 23 comprises on its outside diameter a groove 17 and an orthogonal bore 15 which allow the passage of part of the oxygen flow from the conduit connected to the needle valve 9.

The needle valve 9 is then connected to the bore 8 by a line 36 made up from material compatible with the passage of oxygen. The closing and opening of the needle valve 9 allows the bypassing (withdrawal) or not into the bypass circuit 36 of an amount of oxygen required for the operating conditions. The oxygen thus withdrawn into the recess 7 (withdrawal orifice) via an opening in the needle valve 9 is then reintroduced via the circuit 36 into the ring 17 (carrier gas reintroduction orifice), passes into the bore 15 and then terminates in an annular space in the negative pressure zone 19. In this way, at the outlet of the injector 12, the accelerated oxygen flow rate leaving the sonic throat convergent-divergent nozzle 3 is recovered. The expression bypass circuit 36 is applied to the assembly consisting of the recess 7, the bore 8, the needle valve 9, the reintroduction orifice 17, the bore 15.

The operation and the other elements are identical to the description given for FIG. 2.

EXAMPLE

A constant $O_2$ flow rate enters the inventive device with a value of 30 $Nm^3/h$ and has a pressure at the outlet of the pressure reducer 2 of 5.2 bar. The maximum useful pressure of the injector inlet (static pressure) is 4.05 bar. The needle valve, initially closed, was gradually opened and the mass flow rate of pulverulent material was measured. The results are given in the table below.

| Position of needle valve | Static P measured by pressure gauge max (11) (bar) | Exit mass flow rate of pulverulent material (kg/h) |
|---|---|---|
| Closed | 4.05 | 83.5 |
| Open + | 3.75 | 70 |
| Open ++ | 3.5 | 62.7 |
| Open +++ | 3.25 | 53 |
| Open ++++ | 3 | 48 |
| Open +++++ | 2.8 | 46 |
| Full Open | 2.55 | 42.3 |

It is obvious that the present invention is in no way limited to the embodiments described above and that many changes can be made thereto while remaining within the scope of the appended claims.

The invention claimed is:

1. A device for spraying a pulverulent material into a carrier gas comprising:

a pressurized carrier gas inlet a sonic throat convergent-divergent nozzle communicating with said pressurized carrier gas inlet a pulverulent material feed communicating with a negative pressure zone, means for expanding the carrier gas connected to said sonic throat convergent-divergent nozzle receiving the pressurized carrier gas and terminating in said negative pressure zone and an outlet structure of said pulverulent material entrained by said carrier gas outside the negative pressure zone, wherein said pulverulent material in said carrier gas has a flow rate, wherein the device for spraying further comprises a device for adjusting the flow rate of said pulverulent material in said carrier gas comprising a bypass circuit of said carrier gas equipped with a member for adjusting the amount of bypassed carrier gas, said bypass circuit comprising a carrier gas sampling structure placed upstream of said negative pressure zone of said carrier gas to bleed of an amount of sampled carrier gas and an orifice for reintroducing said amount of sampled carrier gas, wherein the orifice is located in said negative pressure zone, said sonic throat convergent-divergent nozzle being arranged to maintain, downstream, a constant flow rate of carrier gas entraining a predefined amount of pulverulent material.

2. The device as claimed in claim 1, further comprising an injector communicating on the one hand with said sonic throat convergent-divergent nozzle and on the other hand with said expansion means and said negative pressure zone, said injector comprising at least one contraction zone.

3. The device as claimed in claim 1, in which a smallest diameter of said sonic throat convergent-divergent nozzle is less than the diameter of each element downstream of said sonic throat convergent-divergent nozzle.

4. The device as claimed in claim 1, in which said member for adjusting is a needle valve.

5. The device as claimed in claim 2, in which said orifice is placed upstream of said contraction zone of said injector.

6. The device as claimed in claim 1, in which said negative pressure zone is connected to a divergent passage, itself connected to said outlet of said pulverulent material entrained by the carrier gas.

7. The device as claimed in claim 6, in which said outlet of pulverulent material entrained by said carrier gas is a tubular orifice comprising the divergent passage in which a first casing surrounds at least said outlet tubular orifice and in which a second casing surrounds a flexible hose leading to a spray nozzle connected to said outlet, the two casings being joined together.

8. The device as claimed in claim 7, further comprising a thermofusible wire connected on the one hand to a trigger which comprises an open carrier gas flow position and a closed carrier gas blocking position and on the other hand, in said second casing, said thermofusible wire being arranged to maintain said trigger in the open position.

9. The device as claimed in claim 7, in which said first and said second casings are joined to one another by return means having a predefined return force.

10. The device as claimed in claim 9, further comprising a thermofusible wire connected on the one hand to a trigger which comprises an open carrier gas flow position and a closed carrier gas blocking position and on the other hand, between said first and second casings said thermofusible wire being arranged to maintain said trigger in the open position.

11. The device as claimed in claim 2, in which a smallest diameter of said sonic throat convergent-divergent nozzle is less than the diameter of each element downstream of said sonic throat convergent-divergent nozzle.

12. The device as claimed in claim 2, in which said adjusting member is a needle valve.

13. The device as claimed in claim 3, in which said adjusting member is a needle valve.

14. The device as claimed in claim 2, in which said negative pressure zone is connected to a divergent passage, itself connected to said outlet of said pulverulent material entrained by the carrier gas.

15. The device as claimed in claim 3, in which said negative pressure zone is connected to a divergent passage, itself connected to said outlet of said pulverulent material entrained by the carrier gas.

16. The device as claimed in claim 4, in which said negative pressure zone is connected to a divergent passage, itself connected to said outlet of said pulverulent material entrained by the carrier gas.

17. The device as claimed in claim 8, in which said first and said second casings are joined to one another by return means having a predefined return force.

* * * * *